US006880181B2

(12) United States Patent
Nichols-Roy et al.

(10) Patent No.: US 6,880,181 B2
(45) Date of Patent: Apr. 19, 2005

(54) APPARATUS FOR DELAYING THE CLOSING OF A TOILET FLAPPER VALVE

(75) Inventors: David Nichols-Roy, Escondido, CA (US); Charles R. Way, Burlington, WI (US)

(73) Assignee: Lavelle Industries, Inc., Burlington, WI (US)

( * ) Notice: Subject to any disclaimer, the term of this patent is extended or adjusted under 35 U.S.C. 154(b) by 0 days.

(21) Appl. No.: 10/384,219

(22) Filed: Mar. 6, 2003

(65) Prior Publication Data

US 2004/0172746 A1 Sep. 9, 2004

(51) Int. Cl.[7] ..... E03D 1/34
(52) U.S. Cl. ..... 4/379
(58) Field of Search ..... 4/379, 385, 386, 4/388

(56) References Cited

U.S. PATENT DOCUMENTS

| | | | | |
|---|---|---|---|---|
| 2,773,268 A | | 12/1956 | Hurko et al. | 4/57 |
| 3,142,846 A | * | 8/1964 | Lackenmaier et al. | 4/386 |
| 3,969,775 A | | 7/1976 | Haselton | 4/67 |
| 3,988,785 A | | 11/1976 | Schoepe | 4/57 |
| 4,028,748 A | | 6/1977 | Schoepe et al. | 4/52 |
| 4,639,951 A | | 2/1987 | lamot | 4/392 |
| 4,907,302 A | | 3/1990 | Schoepe et al. | 4/382 |
| 4,922,556 A | | 5/1990 | Roosa | 4/378 |
| 5,090,066 A | | 2/1992 | Schoepe et al. | 4/378 |
| 5,153,948 A | | 10/1992 | Smith et al. | 4/415 |
| 5,173,971 A | | 12/1992 | Schoepe et al. | 4/378 |
| 5,293,650 A | * | 3/1994 | Schoepe et al. | 4/378 |
| 5,850,639 A | | 12/1998 | Arita et al. | 4/388 |
| 6,192,526 B1 | | 2/2001 | Nichols-Roy et al. | 4/378 |

* cited by examiner

*Primary Examiner*—Charles E. Phillips
(74) *Attorney, Agent, or Firm*—Joseph S. Heino; Patrick M. Bergin

(57) ABSTRACT

A pair of lever arms each have an intermediate segment configured for pivotal mounting on a pair of pins that support a corresponding end of a pair of mounting arms of a flapper valve. Each of the lever arms has a forward end configured to engage and provide a lifting force on a corresponding one of the flapper valve mounting arms when the lever arm and the flapper valve mounting arm are rotated in a first direction during opening of the flapper valve upon manual actuation of a flush control lever or button. A counterweight reservoir is connected to a pair of rearward ends of the lever arms for holding a volume of water and delays rotation of the flapper valve in a reverse direction to seal the flush valve until a volume of water has drained through an outlet aperture in a bottom portion of the counterweight reservoir.

12 Claims, 5 Drawing Sheets

APPARATUS FOR DELAYING THE CLOSING OF A TOILET FLAPPER VALVE

FIELD OF THE INVENTION

The present invention relates to indoor plumbing, and more particularly, to gravity-operated flush toilets.

BACKGROUND OF THE INVENTION

A conventional gravity-operated flush toilet has several basic components. The porcelain or china components include a bowl and a water tank mounted on top of a rear portion of the bowl. The bowl and tank are usually separate pieces bolted together to form a so-called two-piece toilet. Modern gravity-operated flush toilets are frequently made as a so-called one-piece toilet in which the bowl and tank are made as one continuous integral piece of china. This produces a more sleek and stylish design.

The plumbing components of a gravity-operated flush toilet include a fill valve in the tank which is connected to a water supply line, a flush valve surrounding a drain hole in the bottom of the tank that communicates with the bowl, and a flapper valve that normally closes and seals the flush valve. The plumbing components further include a control such as a pushbutton or lever mounted on a wall of the tank that moves a lever whose remote end is connected to the flapper valve for lifting the same. Two-piece toilets typically include an overflow tube that empties water from the tank through the drain hole in the event of a failure of the fill valve to shut off. One-piece toilets can include a passage through the china that provides the equivalent overflow feature.

Due to water shortages governmental regulations have imposed size limits on the amount of water normally used during a single flush cycle in a gravity-operated flush toilet. In the United States of America there is an EPA regulation placing this limit at approximately 1.6 gallons. Some one-piece toilets have large diameter drain holes in the tank, e.g. more than three inches, in order to improve flushing. However, in such designs there is a tendency for the flapper valve to close too soon, especially due to the significantly higher suction force associated with larger flush valve openings. This may leave as much as two inches of the head of water still standing in the tank and unavailable to help carry away the waste in the bowl.

Various apparatuses have been developed that attempt to alter the closure of a toilet flapper valve. U.S. Pat. No. 5,153,948 of Smith et al. discloses the use of a float connected to an upper end of a strap whose lower end is connected to the body portion of the flapper valve to provide additional buoyancy so that less than half of the tank is emptied. This may have been an acceptable arrangement for toilets with tanks providing five gallon flushes and with tanks providing three and one-half gallon flushes, but it is not acceptable for newer gravity-operated flush toilets that are limited to flush volumes of 1.6 gallons. Any use of such an auxiliary float to delay the closing of a flapper valve in a low volume gravity-operated flush toilet would be problematic. For one thing, the constant upward force exerted by the auxiliary float on the flapper valve could inhibit its ability to properly seal the flush valve.

U.S. Pat. No. 3,969,775 of Haselton and U.S. Pat. No. 4,922,556 of Roosa disclose other arrangements for attaching a float to the chain that connects the flapper valve to the manual flush control lever.

U.S. Pat. No. 2,773,268 of Hurko et al. discloses a flush valve assembly including a valve member seated on a valve seat that surrounds a tank outlet, a bell crank lever with a first arm secured to the valve member, pivot means for the intermediate part of the bell crank lever and a counterweight secured to a second arm of the bell crank lever. The counterweight includes a hollow cylindrical container with an aperture extending through its bottom wall. A cylindrical float member is also secured to the second arm of the bell crank lever. The valve member remains open until a sufficient amount of water in the container has drained out through the aperture during the flush cycle. This flush valve assembly is not adaptable to work with conventional flapper valves, but instead operates as a complex system of interconnected valve member, bell crank lever, container and float member. It is also complex, bulky and requires substantial space within the tank.

U.S. Pat. No. 4,639,951 of Lamot discloses a wear plate that is designed for use with the flush valve assembly of the aforementioned U.S. Pat. No. 2,773,268 of Hurko et al.

U.S. Pat. No. 4,907,302 of Schoepe et al. discloses an in-field installable device including a cup attached directly to the top of a tank ball so that when the tank ball is pivoted to a fully open position the cup is pivoted to a side of the pivot axis opposite the tank ball to delay closing of the flush valve. This device is not adapted to work with a conventional flapper valve.

U.S. Pat. No. 5,293,650 of Schope et al. discloses a replacement flush valve device that is sold in the United States under the trademark FLUSHER FIXER® and also under the designation FLUIDMASTER® 555C Flapper, Drain Seat & Timing Cup. A closing delay cup is mounted on a rigid yoke that carries an elastomeric tank ball that is mounted to the outer portion of the yoke in a universal joint. The other end of the yoke is pivotally connected to a rigid seat member. The legs of the yoke have slots and the delay cup has a pair of projections that fit into the slots so that the delay cup is positioned above the tank ball when the tank ball is closed. This device is also not adapted to work with a conventional flapper valve. The seat member must be oriented relative to the overflow tube so that pivotal motion of the yoke is not impaired. This device also requires the gluing or adhesive attachment of a new drain seat with new pivot pins on top of the conventional flush valve associated with the overflow tube. This is a cumbersome process requiring several additional components.

U.S. Pat. No. 5,850,639 of Arita et al. assigned to Toto, Ltd. discloses the attachment of a damping plate to the rearward ends of a pair of support arms that are pivotally connected to the overflow tube with a shaft. The forward ends of the arms are connected to a disk-like valve body for sealing and unsealing a tank drain valve seat. When the flush control is actuated to unseal the valve body from the tank drain valve seat the pressure of the descending flow applied to the damping plate acts as a resistance against the motion of the valve body attempting to drop due to the force of gravity. Eventually as the tank drains the damping plate is held to the surface of the water in the tank by surface tension to keep the valve body open. When the level of water in the tank drains to a point where the surface tension is lost, the valve body descends and closes the tank drain.

The aforementioned devices for delaying the closure of a flapper valve are generally complex, expensive and not usable with conventional flapper valves with and without integral floats. A delay device installable independently of the flapper valve would be desirable.

SUMMARY OF THE INVENTION

It is therefore the primary object of the present invention to provide an apparatus for delaying the closing of a conventional flapper valve during the flushing of a gravity-operated toilet.

It is another object of the present invention to provide an improved gravity-operated flush toilet in which a larger proportion of the head of water in the tank is evacuated and used to help carry away waste in the bowl.

In accordance with the present invention an apparatus is provided for delaying the closing of a flapper valve during the flushing of a gravity-operated toilet. The apparatus includes a pair of lever arms each having an intermediate segment configured for pivotal mounting on a pair of pivot pins that each pivotally support a corresponding end of a pair of mounting arms of an existing conventional flapper valve. The flapper valve has a body portion that normally seals a flush valve mounted in a bottom wall of a toilet tank. Each of the lever arms has a forward end configured to engage and provide a lifting force on a corresponding one of the flapper valve mounting arms. This lifting force is exerted when the lever arm and the flapper valve mounting arm are rotated in a first direction to a first position upon manual actuation of a flush control. Rotation of the flapper valve in the first direction unseals the body portion from the flush valve to permit a first volume of water in the toilet tank to drain through a drain hole surrounded by the flush valve. A counterweight reservoir is connected to a pair of rearward ends of the lever arms for holding a volume of water that delays rotation of the lever arms and the flapper valve mounting arms in a second direction opposite the first direction. Rotation of the flapper valve in the second direction seals the body portion with the flush valve seat and is delayed until a predetermined amount of a second volume of water has drained through an outlet aperture in a bottom portion of the counterweight reservoir.

The present invention also provides an improved gravity-operated flush toilet. The toilet includes a bowl and a tank sitting above the bowl. The tank has a bottom wall with a drain hole that communicates with the bowl. A flush valve surrounds the drain hole. A pair of pivot pins are supported directly or indirectly by the tank adjacent to the flush valve. A flapper valve has a body portion that is normally seated on the flush valve to seal the drain hole. The flapper valve also has a pair of mounting arms with remote ends that are connected to the pivot pins so that the mounting arms can swing upwardly to unseat the body portion from the flush valve to unseal the drain hole. The toilet further includes a fill valve mounted in the tank for connection to a water supply line that automatically fills the tank to a predetermined level. The tank has an overflow tube or built-in passages for preventing the tank from overflowing above an upper edge thereof. A flush control is mounted on a wall or cover of the tank and is connected to the body portion of the flapper valve through a linkage for lifting the body portion to unseal the drain hole. This allows water from the tank to pass through the drain hole into the bowl. A counterweight mechanism is separately mounted to the pivot pins for engaging the mounting arms of the flapper valve to delay the movement of the body portion from an unseated position to a seated position after the body portion has been lifted by manual actuation of the flush control. This increases an amount of water in the tank that would otherwise flow through the drain opening into the bowl before the body portion moves to its seated position.

Our invention also provides a method of delaying the closure of a flapper valve in a gravity-operated flush toilet in order to improve the flushing action of the toilet. The method involves the step of separately mounting a pair of intermediate segments of a pair of lever arms extending from a counterweight reservoir to a pair of pivot pins that pivotally support the rear ends of a pair of mounting arms of an existing flapper valve so that a pair of forward ends of the lever arms can lift the mounting arms of the flapper valve. The method further involves the step of controlling the rate at which a small quantity of water drains from the counterweight reservoir during a flush cycle to delay the closure of the flapper valve a sufficient amount of time to ensure that substantially all of a larger quantity of water drains from the tank in which the flapper valve is mounted through a drain hole normally sealed by the flapper valve.

DESCRIPTION OF THE PREFERRED EMBODIMENT

Figure 1:
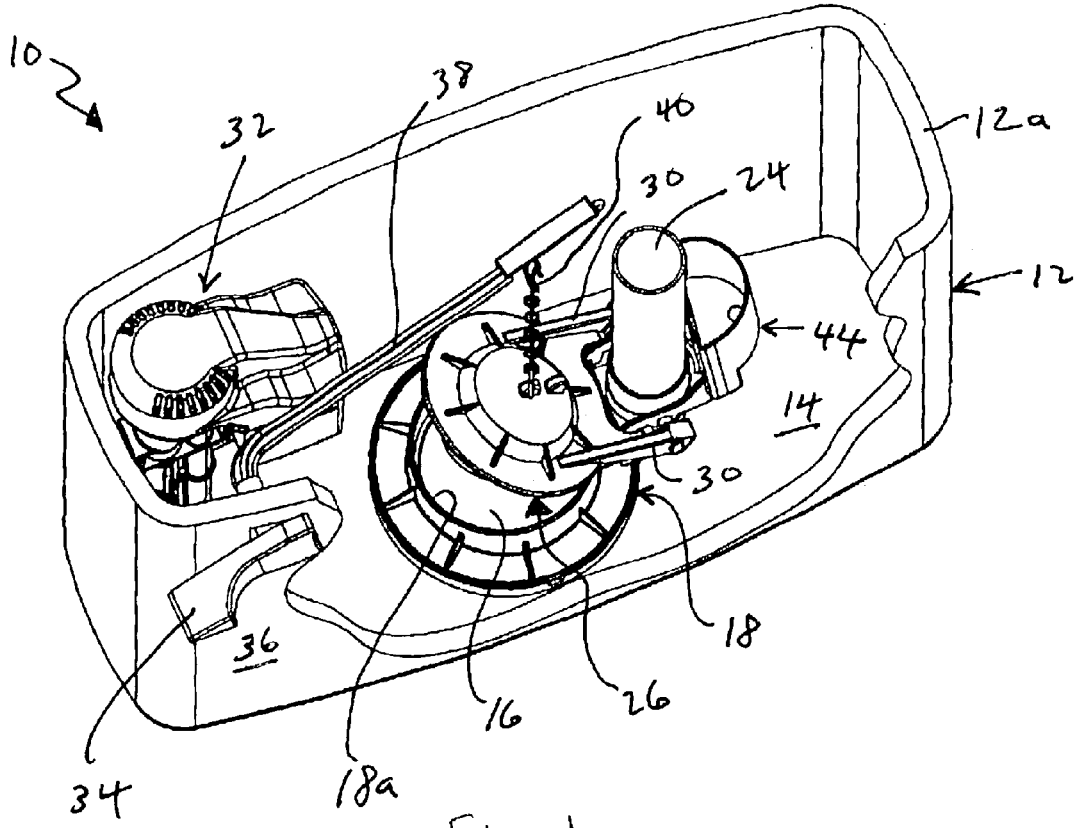
FIG. 1 is a cut away perspective view taken from above a toilet tank of a gravity-operated flush toilet incorporating a flapper valve closure delay apparatus in accordance with a preferred embodiment of the present invention.

Referring to FIG. 1, in accordance with the present invention an improved gravity-operated flush toilet 10 includes a porcelain or china bowl (not illustrated) and a porcelain or china tank 12 sitting above the bowl. In the preferred embodiment, the china portion of the toilet 10 has one-piece construction but our invention is equally usable with gravity-operated flush toilets having a two-piece construction. The tank 12 is preferably sized to hold approximately 1.6 gallons of water when filled to a level a couple of inches below the upper edge 12*a* thereof. The tank 12 has a horizontal bottom wall 14 with a drain hole 16 that communicates with the bowl. A flush valve 18 surrounds the drain hole 16. The drain hole 16 preferably has a relatively large diameter, e.g. three inches, in order to insure proper flush of waste from the bowl of the toilet 10. Since the drain hole 16 is "blind", i.e. not accessible from below the bottom wall 14, it is very difficult, if not impossible, to manually thread a conventional large nut over a male threaded bottom portion of a flush valve inserted into the drain hole 16. Therefore, the flush valve 18 is preferably of the type disclosed in U.S. Pat. No. 6,192,526 B1 of Nichols-Roy et al. granted Feb. 27, 2001 and entitled TOP MOUNTED FLUSH VALVE FOR A TOILET TANK, the entire disclosure of which is hereby incorporated by reference. The aforementioned patented flush valve is installed in the drain hole 16 of the tank 12 using a spring nut that is rotated from above the bottom wall 14 with a drive collar to press a seal member against the underside of the bottom wall 14.

A pair of pivot pins 20 (FIG. 6) extend horizontally from opposite sides of a cylindrical socket 22 of the flush valve 18. The socket 22 receives and holds the lower end of a cylindrical upright overflow tube 24. A flapper valve 26 (FIG. 3) has a body portion 28 that is normally seated on the flush valve 18 to seal the drain hole 16. The flapper valve 26 also has a pair of spaced apart parallel mounting arms 30 (FIG. 2) with remote or rear ends that are connected to the pivot pins 20 so that the mounting arms 30 can swing upwardly to unseat the body portion 28 from the flush valve 18 to unseal the drain hole 16. The body portion 28 of the flapper valve 26 is typically made of an elastomeric material such as synthetic rubber having a suitable durometer or softness. The body portion 28 has a disc shaped upper portion 28*a* (FIG. 3) with an annular peripheral lip that mates with the cylindrical valve seat 18*a* of the flush valve 18. The body portion 28 of the flapper valve 26 also has a central ball shaped or cup-shaped lower portion 28*b* that typically includes a downwardly opening interior cavity. Once a flush cycle is initiated the pocket of air within this cavity provides sufficient buoyancy to keep the flapper valve 26 open until most of the water within the tank 12 has passed through the drain hole 16 into the bowl.

The toilet 10 further includes a fill valve 32 (FIG. 1) that is mounted in the tank 12 for connection to a water supply line (not illustrated) and that automatically fills the tank 12 to a predetermined level below the upper edge 12*a* of the tank 12. The fill valve is preferably a pilot operated fill valve of the type illustrated in U.S. Pat. No. 6,260,574 B1 of Nichols-Roy granted Jul. 17, 2001 and entitled TOILET TANK FILL VALVE CONNECTABLE TO RISER WITH PRE-SELECTED HEIGHT, the entire disclosure of which is hereby incorporated by reference. Details of the pilot operated diaphragm valve, float arm, strainer and noise suppressor of the fill valve 32 are disclosed in U.S. Pat. No. 5,715,859 of Nichols-Roy granted Feb. 10, 1998 and entitled ADJUSTABLE FILL VALVE ASSEMBLY, the entire disclosure of which is hereby incorporated by reference. If for any reason the fill valve 32 should malfunction, the excess water spills into the upper end of the overflow tube 24 and through a passage 33 (FIG. 3) in base structure of the flush valve 18 into the drain hole 16 while the flapper valve 26 is still in its closed position illustrated in FIG. 2. This prevents the water in the tank 12 from spilling over the upper edge 12*a* of the tank 12. Alternatively, the tank 12 could also be fabricated with built-in passages (not illustrated) or some other means for preventing the tank from overflowing above the upper edge 12*a* thereof.

A control flush 34 (FIG. 1) is mounted on a front wall 36 or cover (not illustrated) of the tank 12 and is connected to the body portion of the flapper valve 28 through a linkage for lifting the body portion 28 to unseal the drain hole 16. This allows water from the tank 12 to rapidly flow through the drain hole 16 into the bowl of the toilet 10. In the preferred embodiment 10 of our gravity-operated flush toilet, the flush control 34 is in the form of a short lever on the upper left exterior of the front wall 36 of the tank 12. The flush control 34 is manually rotated a small amount in order to initiate a flush cycle. The linkage includes a longer lever 38 having an inner end rigidly secured to the same shaft (not visible) that rotatably supports the flush control 34. The outer end of the longer lever 38 is connected to additional parts of the linkage including the upper end of a chain 40 whose lower end is connected to a ring 42 (FIG. 3) extending through a tab portion 28*c* in the top center of the disc shaped upper portion 28*a* of the flapper valve 26.

Figure 2:
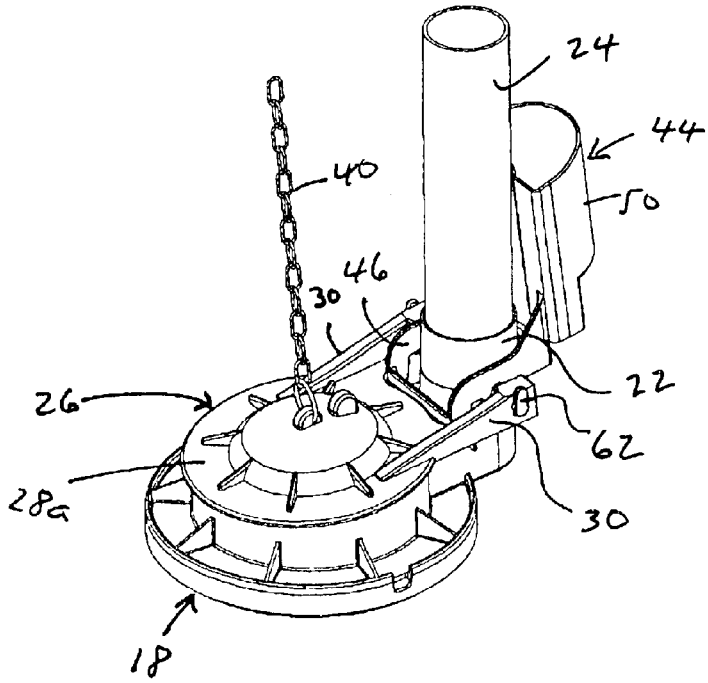
FIG. 2 is an enlarged perspective view from one side of the flush valve, flapper valve, overflow tube and flapper valve closure delay apparatus of the preferred embodiment, with the flapper valve in its closed position.
Figure 3:
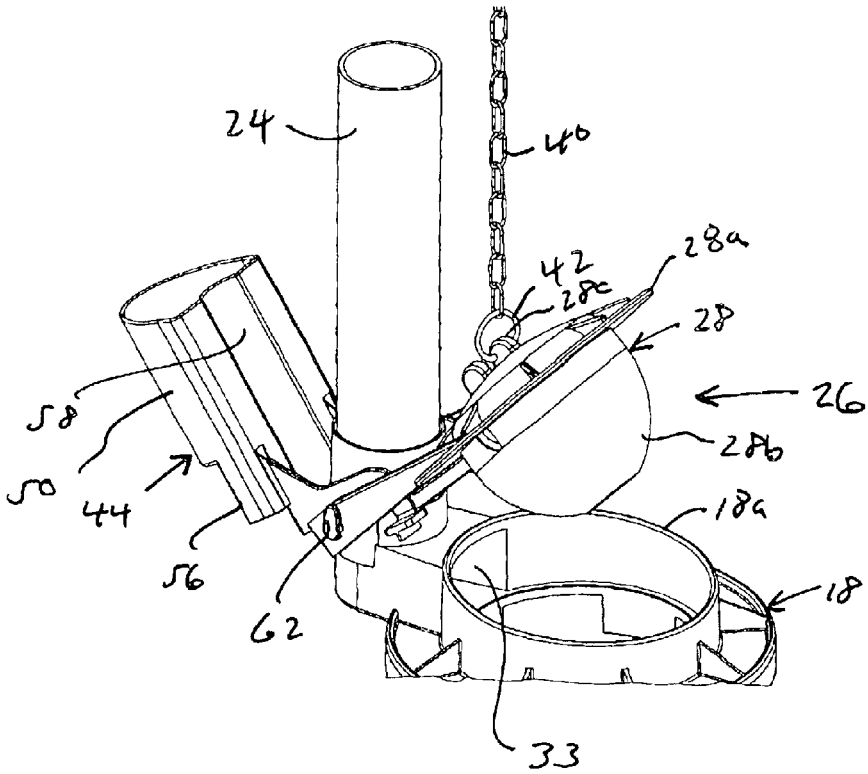
FIG. 3 is a view similar to FIG. 2 except that it is taken from the opposite side and the flapper valve is in its open position.

A counterweight mechanism 44 (FIG. 1) is separately mounted to the pivot pins 20 (FIG. 6) for engaging the mounting arms 30 of the flapper valve 26 in order to delay the movement of the body portion 28 from an unseated position illustrated in FIG. 3 to a seated position illustrated in FIG. 2 after the body portion 28 has been lifted by manual actuation of the flush control 34. This increases an amount of water in the tank 12 that would otherwise flow through the drain opening 16 into the bowl before the body portion 28 moves to its seated position. Note that in FIG. 1, for the sake of illustrating the various parts, the tank 12 is empty of water and the flapper valve 26 has been illustrated partially lifted in order to show the drain hole 16 in the bottom wall 14 of the tank 12. In FIG. 1 the counterweight mechanism 44 is shown in its raised position, but ordinarily it would be rearwardly tilted to its lowered or inclined position illustrated in FIG. 3 when the flapper valve 26 is fully open.

The counterweight mechanism 44 (FIG. 2) delays the closing of a flapper valve 26 during the flushing of the gravity-operated toilet 10 in order to improve the flushing action of the toilet. This allows a larger percentage of the water normally stored in the tank 12 to flow through the drain hole 16 into the bowl to evacuate waste therefrom. Without the counterweight mechanism 44 two or more inches of water can remain in the tank 12 at the end of a flushing cycle when the flapper valve 26 moves to its closed or sealing position illustrated in FIG. 2. With the addition of the counterweight mechanism 44, the head of water in the tank 12 that is not drained during a flush cycle can be reduced to one-half inch or less.

The counterweight mechanism 44 is preferably injection molded as a single unitary piece of plastic. It includes a pair of generally L-shaped lever arms 46 (FIG. 4) each having an intermediate segment 46*a* configured for pivotal mounting on the pair of horizontal pivot pins 20 that each also pivotally support a corresponding end of the pair of mounting arms 30 of the existing conventional flapper valve 26. Each intermediate segment 46*a* has a downwardly opening arcuate recess 48 formed therein so that the lever arms 46 can simply be dropped onto their corresponding pivot pins 20. The arcuate recesses 48 are formed by pairs of inverted V-shaped projections 49. The intermediate segments 46*a* are thus configured to act as trunnions. Each of the lever arms 46 has a forward end 46*b* configured to engage and provide a lifting force on a corresponding one of the flapper valve mounting arms 30. This lifting force is exerted when the lever arm 46 and the flapper valve mounting arm 30 are rotated counter-clockwise in FIG. 3 in a first direction to a raised open position upon manual actuation of the flush control 34. Counter-clockwise rotation of the flapper valve 26 in the first direction unseals the body portion 28 from the flush valve 18 to permit a first relatively large volume of water in the toilet tank 12 (approximately 1.6 gallons) to drain through the drain hole 16 surrounded by the flush valve 18.

A counterweight reservoir 50 (FIGS. 5 and 6) is connected to a pair of rearward ends 46*c* of the lever arms 46 for holding a relatively small volume of water that delays rotation of the lever arms 46 and the flapper valve mounting arms 30 in a second clockwise direction in FIG. 3. Clockwise rotation of the flapper valve 26 in the second direction seals the body portion 28 with the flush valve 18. This clockwise rotation of the flush valve 26 to its lowered closed position illustrated in FIG. 2 is delayed until a predetermined amount of a relatively small volume of water has drained through an outlet aperture 52 (FIG. 5) in a bottom portion 54 of the counterweight reservoir 50. A float reservoir 56 is located directly below the counterweight reservoir 50 and consists of a downwardly opening receptacle also connected to the rear ends 46*c* of the lever arms 46. The float reservoir 56 traps a volume of air when the tank 12 is refilled during a flush cycle and the buoyancy of the float reservoir 56 pushes the rearward ends 46*c* of the lever arms 46 upwardly to insure that the counterweight mechanism 44 does not lift up on the flapper valve 26 when the tank 2 is full, without manual actuation of the flush control 34. This ensures that the counterweight mechanism 44 does not interfere with the formation of a proper seal between the peripheral lip of the body portion 28*a* and the valve seat 18*a* of the flush valve 18.

Figure 4:
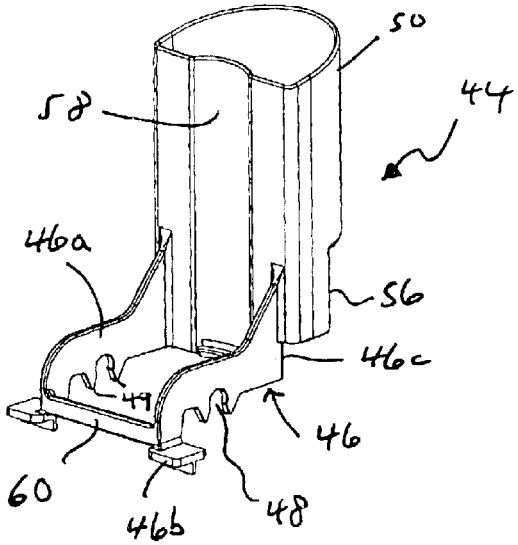
FIG. 4 is a perspective view of the flapper valve closure delay apparatus by itself.

The counterweight reservoir 50 has a semi-circular cross-section as best seen in FIG. 4. The counterweight reservoir 50 and the float reservoir 56 are vertically stacked and share a common vertical semi-circular exterior channel 58. The forward ends 46*b* of the lever arms 46 are joined by a stabilizing cross-member 60. When the counterweight mechanism 44 is installed in the toilet 10, it is slid downwardly over the overflow tube 24 until the intermediate segments 46*a* of the lever arms 46 are mounted over corresponding ones of the pivot pins 20, with the pivot pins 20 being received in the arcuate recesses 48. The semi-circular channel 58 is dimensioned and configured to be complementary to the outer diameter of the overflow tube 24. The forward ends 46*b* of the lever arms 46 are positioned on the insides of the corresponding mounting arms 30 of the flapper valve 26 and provide horizontal platforms that can engage and lift the bottom edges of the forward ends of the flapper valve mounting arms 30. It will be understood that our counterweight mechanism 44 loosely cooperates with a separately installed, existing conventional flapper valve 26 and is not integrally connected thereto. Thus our flapper valve closure delay mechanism can be installed either in the factory, or in the field by plumbers and homeowners and will modify conventional low volume gravity-operated flush toilets so that they achieve improved flushing action.

Up-turned ears 62 (FIG. 5) on the ends of the pivot pins 20 serve to retain the rearward ends of the flapper valve mounting arms in pivotal relationship with the horizontally extending pivot pins 20. The structure of the counterweight mechanism 44 that forms the lower end of the semi-circular channel 58 can engage the overflow tube 24 to provide one end limit of rotation. The structure of the counterweight mechanism 44 that forms the upper end of the semi-circular channel 58 can engage the overflow tube 24 to provide another end limit of rotation.

The size of the outlet aperture 52 (FIG. 5) in the counterweight reservoir 50 can be varied to control the amount of delay in the closure of the flapper valve 26. For example the bottom portion 54 of the counterweight reservoir 50 can be manufactured with one or more knock-outs that can be pierced by the installer to adjust the speed of drainage. Alternatively, the bottom portion 54 can be provided with a plurality of pre-formed small outlet apertures that can be selectively plugged with small plastic insert plugs. Generally, the more rapidly that the counterweight reservoir 50 drains, the shorter will be the delay in the closure of the flapper valve 26.

When the tank 12 is refilled with water, the weight of the head of water in the tank (1.6 gallons) pushes down on the body portion 28 of the flapper valve 26 and overcomes the buoyancy of the cup-shaped lower portion 28*b* of the body portion 28. This head of water pushes the peripheral lip of the disc shaped upper portion 28*a* of the body portion 28 against the valve seat 18*a* of the flush valve 18 to maintain a watertight seal. When the tank 12 is refilled, the counterweight reservoir 50 is also refilled since it ends up being completely submerged. However, when the tank 12 is refilled, a quantity of air is trapped in the float reservoir 56 to provide a slight upward biasing force. During the flushing cycle, after the flapper valve 26 has been lifted to its open position illustrated in FIG. 3, the water in the counterweight reservoir 50 slowly drains until the weight on the reward ends 46*c* of the lever arms 46 is less than the weight on the forward ends 46*b* of the lever arms 46, at which time the flapper valve 26 closes.

Figure 5:
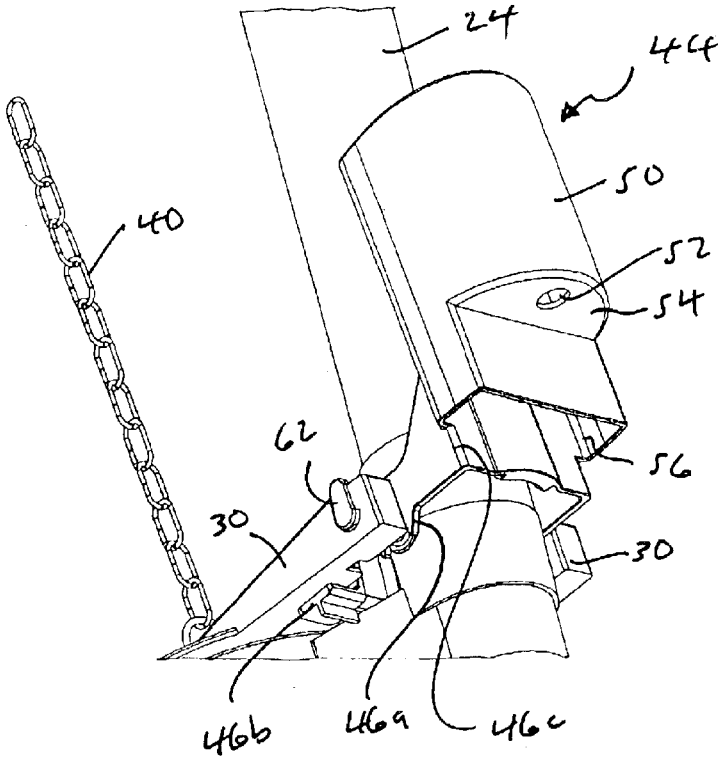
FIG. 5 is an enlarged fragmentary perspective view taken from below and slightly to the right side of FIG. 2 illustrating details of the mounting of the flapper valve and the flapper valve closure delay apparatus on the same pivot pins as the flush valve.
Figure 6:
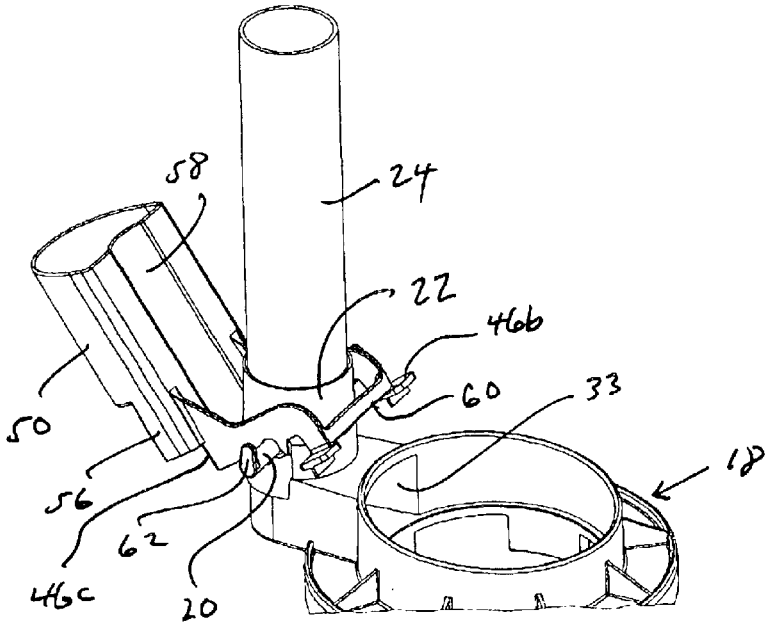
FIG. 6 is a view similar to FIG. 3 with the flapper valve removed.
Figure 7:
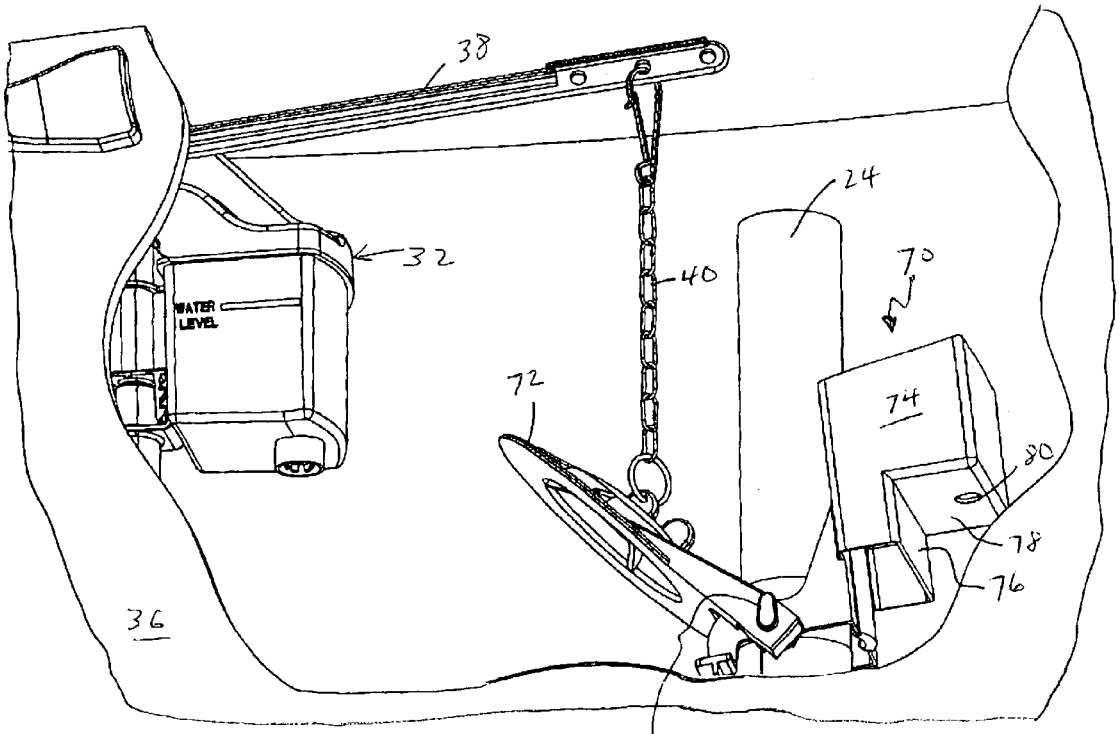
FIG. 7 is a cut away perspective view taken from the side of a toilet tank of a gravity-operated flush toilet incorporating a flapper valve closure delay apparatus in accordance with an alternate embodiment of the present invention.

FIG. 7 is a cut away perspective view taken from the side of a toilet tank of a gravity-operated flush toilet incorporating a flapper valve closure delay apparatus 70 in accordance with an alternate embodiment of the present invention. The apparatus 70 is designed to work with a flapper valve 72 of the type that does not have a buoyancy chamber. The apparatus 70 is similar in all respects to the counterweight mechanism 44 (FIGS. 1 and 2) except that the former has a larger counterweight reservoir 74 that is larger than the counterweight reservoir 50 (FIGS. 5 and 6). The counterweight reservoir 74 and the float reservoir 76 underneath the same both have a rectangular cross-section. The bottom wall 78 of the counterweight reservoir 74 has an outlet aperture 80 that is appropriately sized to achieve the optimum amount of delay of the closure of the flapper valve 72. The larger counterweight reservoir 74 compensates for the lack of additional buoyancy provided by the missing buoyancy chamber in the flapper valve 72.

Figure 8:
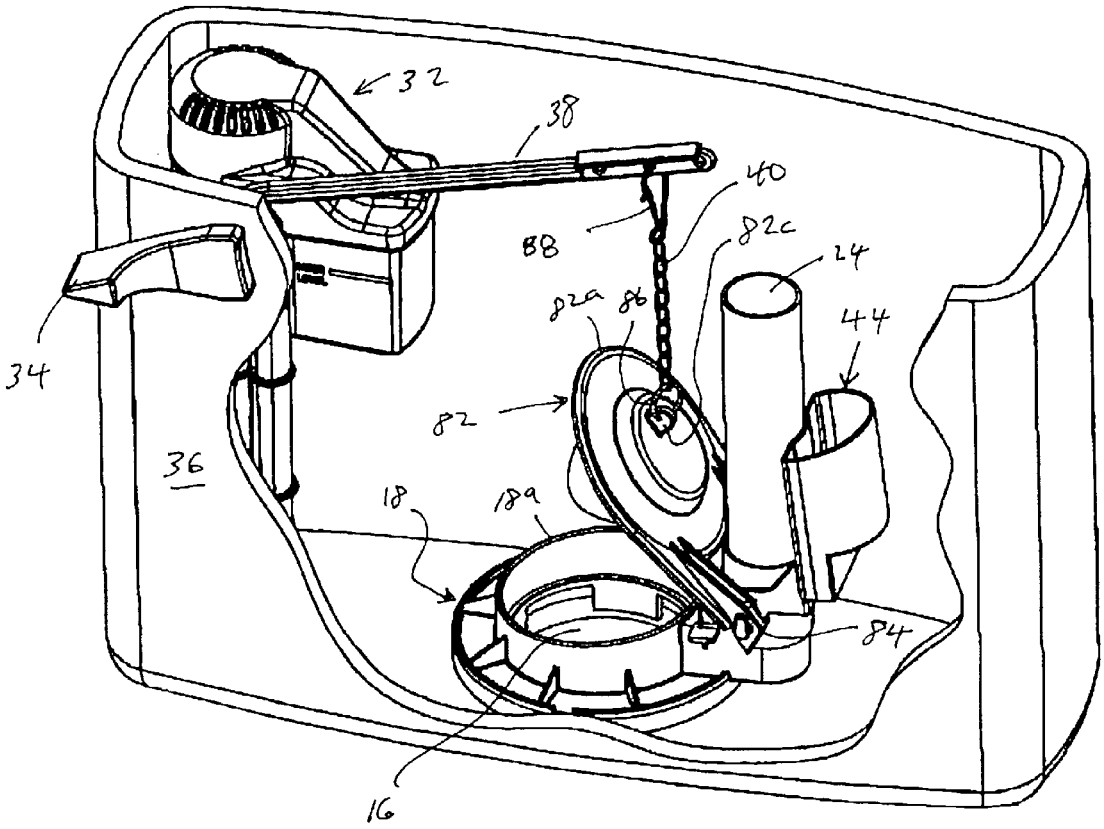
FIG. 8 is a cut away perspective view taken from the side of a toilet tank of a gravity-operated flush toilet incorporating the flapper valve closure delay apparatus of FIGS. 1–6 in conjunction with a different flapper valve.

FIG. 8 is a cut away perspective view taken from the side of a toilet tank of a gravity-operated flush toilet incorporating the counterweight mechanism 44 of FIGS. 1–6 operating with a flapper valve 82 sold by Lavelle Industries, Inc., the assignee of the subject application, under the trademark KORKY®. The flapper valve 82 is preferably made of an elastomeric material. The flapper valve 82 has a disc shaped upper portion 82*a* with an annular peripheral lip that mates with the cylindrical valve seat 18*a* of the flush valve 18. The flapper valve 82 also has a pair of spaced apart parallel mounting arms 84 whose remote or rear ends are pivotally connected to pivot pins 20 so that the mounting arms 84 can swing upwardly to unseat the disc shaped upper portion 82*a* from the cylindrical valve seat 18*a*. The flapper valve 82 also has a central cone shaped lower portion 82*b* that includes a downwardly opening interior cavity. Once a flush cycle is initiated the pocket of air within this cavity provides sufficient buoyancy to keep the flapper valve 82 open until most of the water within the tank 12 has passed through the drain hole 16 into the bowl. A tab portion 82*c* in the top center of the disc shaped portion 82*a* of the flapper valve 82 holds a small ring 86. The lower end of the chain 40 is connected to the ring 86 and the upper end of the chain 40 is connected to the outer end of the lever 38 via releasable clip 88.

Our invention also provides a method of delaying the closure of a flapper valve 26 in a gravity-operated flush toilet 10 in order to improve the flushing action of the toilet 10. The method involves the initial step of separately mounting a pair of intermediate segments 46*a* of a pair of lever arms 46 extending from a counterweight reservoir 50 to a pair of pivot pins 20 that pivotally support the rear ends of a pair of mounting arms 30 of an existing conventional flapper valve 26 so that a pair of forward ends 46*b* of the lever arms 46 can lift the mounting arms 30. The method further involves the subsequent step of controlling the rate at which a small quantity of water drains from the counterweight reservoir 50 during a flush cycle to delay the closure of the flapper valve 26 a sufficient amount of time to ensure that substantially all of a larger quantity of water drains from a tank 12 in which the flapper valve 26 is mounted through a drain hole 16 normally sealed by the flapper valve 26. The rate of drainage of water from the counterweight reservoir is controlled by selecting the number and/or size of the outlet aperture(s) 52 as well as the size, configuration and location of the counterweight reservoir 50 relative to the lever arms 46 and relative to the size, weight and geometry of the flapper valve 26. Of course the amount of flapper valve closure delay could also be adjusted by dropping weights such as washers, nuts, coins, etc. into the counterweight reservoir 50 that do not obstruct the outlet aperture 52.

Whereas we have described a preferred embodiment of our flapper valve closure delay apparatus and a gravity-operated flush toilet employing the same, modifications and adaptations thereof will occur to persons skilled in the art. For example, the configuration of the forward ends 46*b* of the lever arms 46 could be varied to mate with the configuration of the particular flapper valve 26 being utilized. The lever arms 46 could be attached to the lever arms 30 with clips or could be configured to mate with the mounting arms 30 in other ways such as using cooperating tabs and slots as used in the aforementioned FLUSHER FIXER device. The flapper valve 26 could have a soft elastomeric cup-like sealing portion 28 supported by rigid plastic mounting arms 30, such as the arrangement utilized in the aforementioned FLUSHER FIXER device. The pivot pins 20 to which the flapper valve mounting arms 30 and the lever arms 46 of the delay apparatus are pivotally mounted can be part of the flush valve assembly 18, or part of the overflow tube assembly 24, or some other supporting assembly. The configuration of the lever arms 46, counterweight reservoir 50 and float reservoir 56 can be widely varied. The float reservoir 56 is optional. Therefore the protection afforded our invention should only be limited in accordance with the scope of the following claims.

We claim:

1. An apparatus for delaying the closing of a flapper valve during the flushing of a gravity-operated toilet, comprising:

a pair of lever arms each having an intermediate segment configured for pivotal mounting on a pair of pivot pins, which pins each pivotally support a corresponding end of a pair of mounting arms of a flapper valve having a body portion that normally seals a flush valve mounted in a bottom wall of a toilet tank, each of the lever arms having a forward end configured to engage and provide a lifting force on a corresponding one of the flapper valve mounting arms when the lever arm and the flapper valve mounting arm are rotated in a first direction to a first position upon manual actuation of a flush control to unseal the body portion from the flush valve to permit a first volume of water in the toilet tank to drain through a drain hole surrounded by the flush valve; and a counterweight reservoir connected to a pair of rearward ends of the lever arms for holding a volume of water that delays rotation of the lever arms and the flapper valve mounting arms in a second direction opposite the first direction to seal the body portion with the flush valve until a predetermined amount of a second volume of water has drained through an outlet aperture in a bottom portion of the counterweight reservoir.

2. The apparatus of claim 1 and further comprising a float reservoir connected to the rearward ends of the lever arms.

3. The apparatus of claim 2 wherein the float reservoir is positioned below the counterweight reservoir.

4. The apparatus of claim 3 wherein the float reservoir is a downwardly opening receptacle.

5. The apparatus of claim 1 wherein the forward ends of the lever arms are connected by a cross-member.

6. The apparatus of claim 1 wherein the intermediate segments of the lever arms have downwardly opening recesses that each receive a corresponding one of the pivot pins.

7. The apparatus of claim 1 wherein the lever arms are spaced apart to extend along either side of an overflow tube.

8. The apparatus of claim 1 wherein the forward ends of the lever arms have horizontal platforms that engage corresponding lower edges of the mounting arms of the flapper valve.

9. The apparatus of claim 1 wherein the counterweight reservoir has a semi-circular cross-section.

10. The apparatus of claim 1 wherein the counterweight reservoir is formed with a semi-circular channel that has a configuration complementary to a cylindrical overflow tube.

11. A gravity-operated flush toilet, comprising a bowl;

a tank sitting above the bowl and having a bottom wall with a drain hole that communicates with the bowl;

a flush valve surrounding the drain hole;

a pair of pivot pins supported by the tank adjacent to the flush valve;

a flapper valve having a body portion normally seated on the flush valve and sealing the drain hole and a pair of mounting arms with remote ends connected to the pivot pins so that the mounting arms can swing upwardly to unseat the body portion from the flush valve to unseal the drain hole;

a fill valve in the tank for connection to a water supply line for automatically filling the tank to a predetermined level;

means mounted in the tank for preventing the tank from overflowing above an upper edge thereof;

a flush control mounted on a wall or cover of the tank and connected to the body portion of the flapper valve through a linkage for lifting the body portion to unseal the drain hole and allow water from the tank to pass through the drain hole into the bowl;

counterweight means separately mounted to the pivot pins for engaging the mounting arms of the flapper valve to delay the movement of the body portion from an unseated position to a seated position after the body portion has been lifted by manual actuation of the control in order to increase an amount of water in the tank that would otherwise not flow through the drain opening into the bowl before the body portion moves to its seated position;

wherein the counterweight means includes a pair of lever arms each having an intermediate segment configured for pivotal mounting on the pivot pins, each of the lever arms having a forward end configured to engage and provide a lifting force on a corresponding one of the flapper valve mounting arms when the lever arm and the flapper valve mounting arm are rotated in a first direction to a first position upon manual actuation of a flush control to unseal the body portion from the flush valve to permit a first volume of water in the toilet tank to drain through a drain hole surrounded by the flush valve, and a counterweight reservoir connected to a pair of rearward ends of the lever arms for holding a volume of water that delays rotation of the lever arms and the flapper valve mounting arms in a reverse direction opposite the first direction to seal the body portion with the flush valve until a predetermined amount of a second volume of water has drained through an outlet aperture in a bottom portion of the counterweight reservoir.

12. A method of delaying the closure of a flapper valve in a gravity-operated flush toilet in order to improve the flushing action of the toilet, comprising:

separately mounting a pair of intermediate segments of a pair of lever arms extending from a counterweight reservoir to a pair of pivot pins that pivotally support the rear ends of a pair of mounting arms of an existing flapper valve so that a pair of forward ends of the lever arms can lift the mounting arms; and controlling the rate at which a small quantity of water drains from the counterweight reservoir during a flush cycle to delay the closure of the flapper valve a sufficient amount of time to ensure that substantially all of a larger quantity of water drains from a tank in which the flapper valve is mounted through a drain hole normally sealed by the flapper valve.

* * * * *